US009745032B1

(12) United States Patent
Thurmond

(10) Patent No.: US 9,745,032 B1
(45) Date of Patent: Aug. 29, 2017

(54) IN-WATER BOAT-WASHING SYSTEM

(71) Applicant: Marc Thurmond, Amarillo, TX (US)

(72) Inventor: Marc Thurmond, Amarillo, TX (US)

( * ) Notice: Subject to any disclaimer, the term of this patent is extended or adjusted under 35 U.S.C. 154(b) by 0 days.

(21) Appl. No.: 15/290,084

(22) Filed: Oct. 11, 2016

(51) Int. Cl.

| | |
|---|---|
| ***B63B 59/08*** | (2006.01) |
| ***B08B 1/00*** | (2006.01) |
| ***B08B 1/04*** | (2006.01) |
| ***A46B 13/02*** | (2006.01) |
| ***A46B 13/00*** | (2006.01) |

(52) U.S. Cl.
CPC ..... *B63B 59/08* (2013.01); *A46B 13/001* (2013.01); *A46B 13/02* (2013.01); *B08B 1/002* (2013.01); *B08B 1/04* (2013.01); *B63B 2059/082* (2013.01)

(58) Field of Classification Search
CPC ..... B63B 59/08
USPC ..... 114/222
See application file for complete search history.

(56) References Cited

U.S. PATENT DOCUMENTS 4,007,701 A * 2/1977 Fike ..... B63B 59/08 114/222
4,043,286 A * 8/1977 Doty ..... B63B 59/08 114/222
D247,437 S * 3/1978 Nelson ..... B63B 59/08 D32/4
4,784,078 A * 11/1988 Feurt ..... B63B 59/08 114/222
4,843,995 A * 7/1989 Bingham ..... B63B 59/08 114/222
5,040,485 A * 8/1991 Bailey ..... B60S 3/04 118/323
5,222,452 A * 6/1993 Maloney ..... B63B 59/08 114/222
5,638,764 A * 6/1997 Sarvela ..... B63B 59/08 114/222
5,947,051 A * 9/1999 Geiger ..... B62D 57/00 114/222
6,067,921 A * 5/2000 Weber ..... B63B 59/08 114/222
6,327,991 B1 * 12/2001 Eichert ..... B63B 59/08 114/222
7,748,337 B2 * 7/2010 Doyle ..... B63B 59/08 114/222
9,284,027 B1 * 3/2016 Kalke ..... B63B 59/06
(Continued)

FOREIGN PATENT DOCUMENTS

WO 9506584 A1 3/1995

*Primary Examiner* — Lars A Olson
*Assistant Examiner* — Jovon Hayes
(74) *Attorney, Agent, or Firm* — Kyle A. Fletcher, Esq.

(57) ABSTRACT

The in-water boat-washing system is an automated system for washing a boat while said boat remains in a body of water. The in-water boat-washing system is configured to receive a boat, and propel said boat through a series of brushes that clean the hull of the boat while said boat remains in a body of water. The series of brushes are further defined with a plurality of bottom brushes, a plurality of left side brushes and a plurality of right side brushes. The in-water boat-washing system includes a plurality of rollers that are configured to rotate in order to propel the boat across the series of brushes. The in-water boat-washing system includes a frame that supports all of the componentry required. A control panel is included and automates all of the series of brushes as well as the plurality of rollers.

12 Claims, 4 Drawing Sheets

(56) References Cited

U.S. PATENT DOCUMENTS

2008/0282956 A1* 11/2008 Morace ..... B63B 59/06
114/222

* cited by examiner

IN-WATER BOAT-WASHING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of boat-washing systems, more specifically, a boat-washing system wherein the boat remains the body of water whilst being washed.

SUMMARY OF INVENTION

The in-water boat-washing system is an automated system for washing a boat while said boat remains in a body of water. The in-water boat-washing system is configured to receive a boat, and propel said boat through a series of brushes that clean the hull of the boat while said boat remains in a body of water. The series of brushes are further defined with a plurality of bottom brushes, a plurality of left side brushes and a plurality of right side brushes. The in-water boat-washing system includes a plurality of rollers that are configured to rotate in order to propel the boat across the series of brushes. The in-water boat-washing system includes a frame that supports all of the componentry required. A control panel is included and automates all of the series of brushes as well as the plurality of rollers.

It is an object of the invention to provide a boat-washing system that works in a body of water so as to enable a hull of a boat to be cleaned whilst said boat remains in the body of water, and thereby alleviating the need to pull the boat out of the water in order to clean the hull.

It is a further object of the invention to provide the in-water boat-washing system with the necessary componentry that automates the washing process such that the boat is configured to be propelled across the series of brushes in order to scrub clean the hull of the boat whilst said boat remains in the body of water.

It is a further object of the invention for the boat to drive itself to an entrance of the in-water boat-washing system, raise an applicable outdrive, and be propelled across the series of brushes in order for the hull of the boat to be cleaned.

These together with additional objects, features and advantages of the in-water boat-washing system will be readily apparent to those of ordinary skill in the art upon reading the following detailed description of the presently preferred, but nonetheless illustrative, embodiments when taken in conjunction with the accompanying drawings.

In this respect, before explaining the current embodiments of the in-water boat-washing system in detail, it is to be understood that the in-water boat-washing system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the in-water boat-washing system.

It is therefore important that the claims be regarded as including such equivalent construction insofar as they do not depart from the spirit and scope of the in-water boat-washing system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
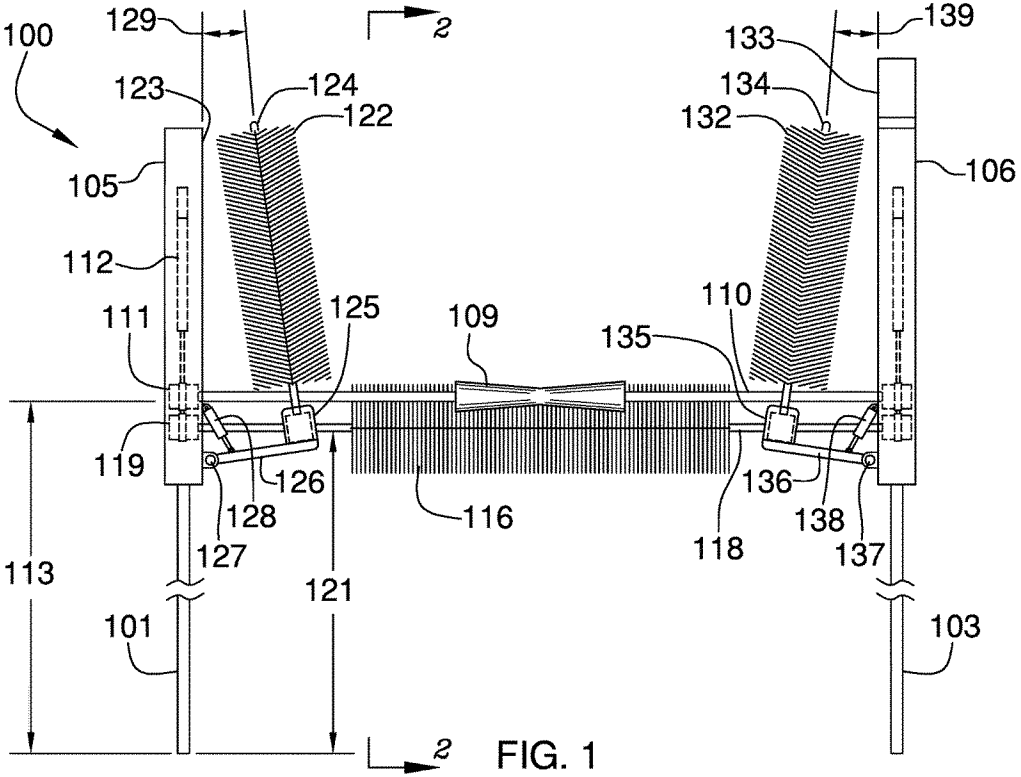
FIG. 1 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The in-water boat-washing system 100 (hereinafter invention) comprises a first mounting post 101, a second mounting post 102, a third mounting post 103, and a fourth mounting post 104. The first mounting post 101, the second mounting post 102, the third mounting post 103, and the fourth mounting post 104 collectively interface with either a ground surface 200 or a supporting structure in order to support the invention 100. The first mounting post 101 and the second mounting post 102 are affixed to a left side frame 105. The third mounting post 103 and the fourth mounting post 104 are affixed to a right side frame 106.

The first mounting post 101 is linearly aligned with the second mounting post 102. The third mounting post 103 is linearly aligned with the fourth mounting post 104. The left side frame 105 is parallel with the right side frame 106. The left side frame 105 is separated from the right side frame 106 via a width 107. The width 107 shall be sized to accommodate a variety of differently-sized boats 300. Moreover, the width 107 shall accommodate differently-sized widths of differently-sized boats 300.

The first mounting post 101, and the second mounting post 102 support the left side frame 105 at an elevation 108. Moreover, the third mounting post 103, and the fourth mounting post 104 support the right side frame 106 at said elevation 108. It shall be noted that the elevation 108 is conducive with a water level depth 401 of a body of water 400. In other words, the first mounting post 101, the second mounting post 102, the third mounting post 103, and the fourth mounting post 104 collectively support the invention 100 such that the left side frame 105 and the right side frame 106 are partially submerged into the body of water 400.

The left side frame 105 and the right side frame 106 are responsible for supporting the components attributed with washing a hull 301 of the boat 300. A plurality of rollers 109 is included with the invention 100. The plurality of rollers 109 extend between the left side frame 105 and the right side frame 106. Moreover, the plurality of rollers 109 are generally parallel with one another. The plurality of rollers 109 are perpendicular with respect to the left side frame 105 and the right side frame 106. Each of the plurality of rollers 109 is mounted on a roller axle 110. The roller axle 110 connects to a roller motor 111. The roller motor 111 is attached to a roller elevation cylinder 112. The roller elevation cylinder 112 is able to raise and lower the roller axle 110 in order to adjust a roller elevation 113. The roller elevation 113 is defined as a span from the ground 200 to the one of the plurality of rollers 109.

Each of the plurality of rollers 109 is a concavely-shaped object that rotates with the roller axle 110. The plurality of rollers 109 is configured to propel the boat 300 from a front entrance 114 to a rear exit 115 of the invention 100. The front entrance 114 is distal of the rear exit 115.

Figure 2:
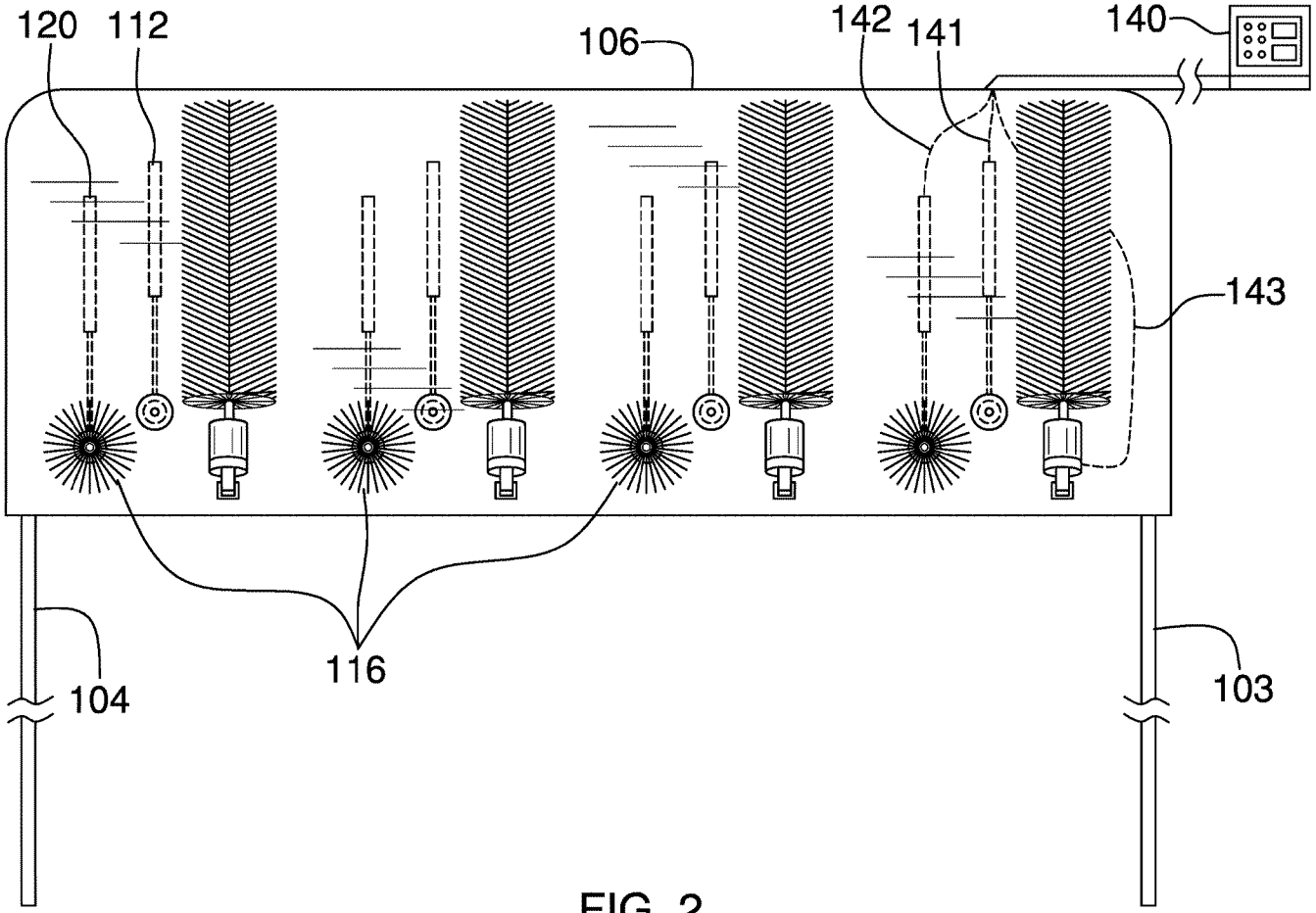
FIG. 2 is a side view of an embodiment of the disclosure.
Figure 3:
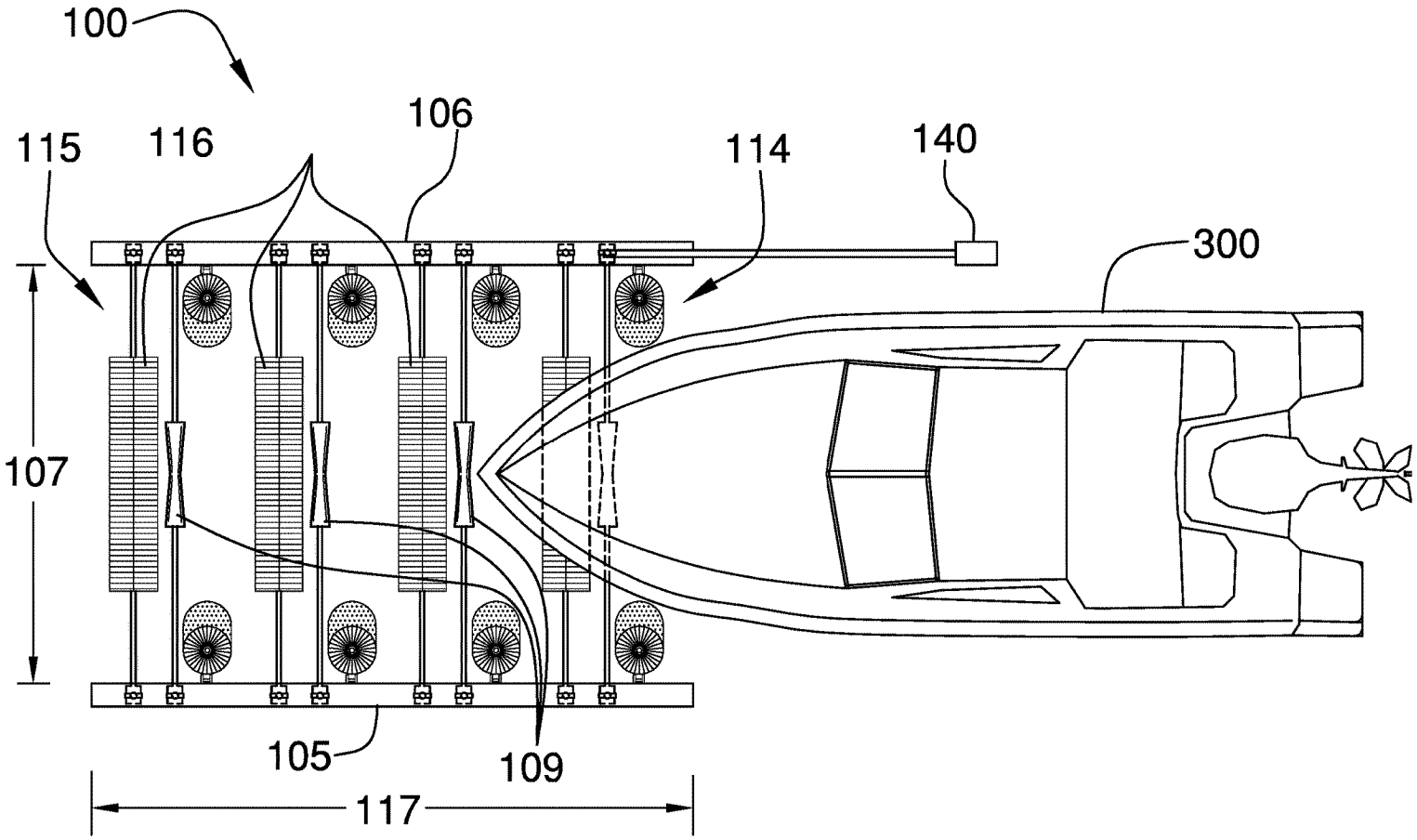
FIG. 3 is a top view of an embodiment of the disclosure.
Figure 4:
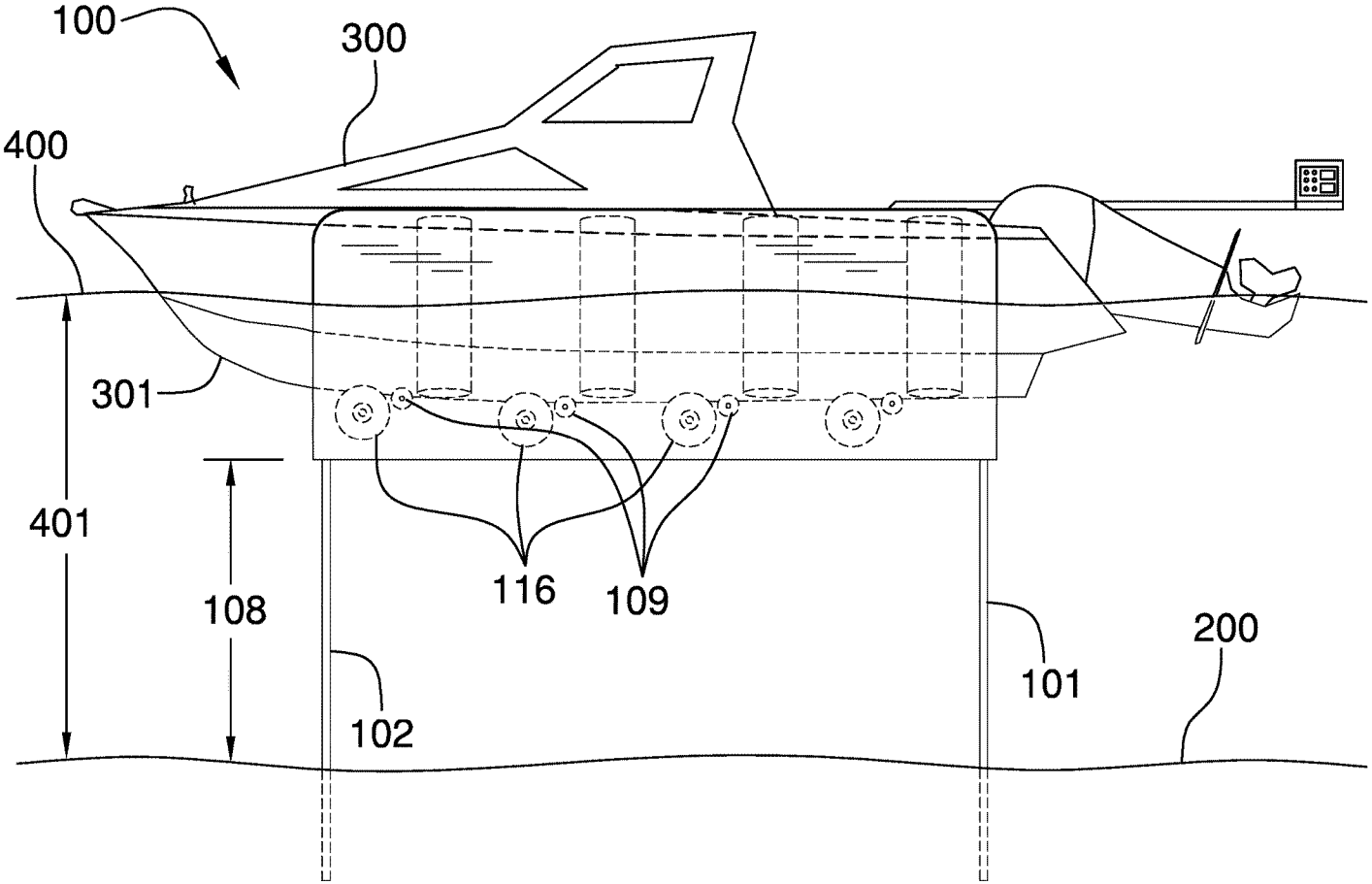
FIG. 4 is an in-use view of an embodiment of the disclosure.

The invention 100 includes a plurality of bottom brushes 116. The plurality of bottom brushes 116 extend in between the left side frame 105 and the right side frame 106. The plurality of bottom brushes 116 are positioned along a length 117 of the invention 100. The length 117 is the span from the front entrance 114 to the rear exit 115. Moreover, the plurality of bottom brushes 116 is parallel with the plurality of rollers 109. Referring to FIG. 2, the plurality of bottom brushes 116 and the plurality of rollers 109 are arranged sequentially such that one of the plurality of bottom brushes 116 is adjacent to at least one of the plurality of rollers 109.

The plurality of bottom brushes 116 is each affixed to a brush axle 118. Each brush axle 118 is affixed to a brush motor 119. The brush motor 119 is attached to a brush elevation cylinder 120. The brush elevation cylinder 120 is able to raise and lower the brush axle 118 in order to adjust a bottom brush elevation 121. The bottom brush elevation 121 is defined as a span from the ground 200 to the one of the plurality of bottom brushes 116.

The invention 100 includes a plurality of left side brushes 122. The plurality of left side brushes 122 are affixed to and pivot with respect to the left side frame 105. Moreover, each of the plurality of left side brushes 122 is provided along a left inner surface 123 of the left side frame 105. Each of the plurality of left side brushes 122 is affixed to a left brush axle 124. The left brush axle 124 is attached to and rotates via a left brush motor 125. The left brush motor 125 is affixed to a left brush pivot arm 126. The left brush pivot arm 126 is pivotably attached to the left side frame 105 via a left pivot pin 127.

A left pivoting cylinder 128 attaches between the left brush pivot arm 126 and the inner left surface 123 of the left side frame 105. The left pivoting cylinder 128 is able to pivot a respective one of the plurality of left side brushes 122 with respect to the hull 301 of the boat 300. A left angle 129 forms relative the left inner surface 123 of the left side frame 105 and the respective one of the left side brushes 122. The left angle 129 is adjustable in order for increased effectiveness when the plurality of left brushes 122 rotate in order to clean the hull 301 of the boat 300.

The invention 100 includes a plurality of right side brushes 132. The plurality of right side brushes 132 are affixed to and pivot with respect to the right side frame 106. Moreover, each of the plurality of right side brushes 132 is provided along a right inner surface 133 of the right side frame 106. Each of the plurality of right side brushes 132 is affixed to a right brush axle 134. The right brush axle 134 is attached to and rotates via a right brush motor 135. The right brush motor 135 is affixed to a right brush pivot arm 136. The right brush pivot arm 136 is pivotably attached to the right side frame 106 via a right pivot pin 137.

A right pivoting cylinder 138 attaches between the right brush pivot arm 136 and the inner right surface 133 of the right side frame 106. The right pivoting cylinder 138 is able to pivot a respective one of the plurality of right side brushes 132 with respect to the hull 301 of the boat 300. A right angle 139 forms relative the right inner surface 133 of the right side frame 106 and the respective one of the right side brushes 132. The right angle 139 is adjustable in order for increased effectiveness when the plurality of right brushes 132 rotate in order to clean the hull 301 of the boat 300.

The right brush motor 135 of all of the plurality of right brushes 132, the left brush motor 125 of all of the plurality of left brushes 122, the roller motor 111 of all of the plurality of rollers 109, and the brush motor 119 of all of the plurality of bottom brushes 116 are in communication with a control panel 140. The brush elevation cylinder 120 of the plurality of bottom brushes 116, roller elevation cylinder 112 of the plurality of rollers 109, the left pivoting cylinder 128 of the plurality of left brushes 122, and the right pivoting cylinder 138 of the plurality of right brushes 132 are in communication with the control panel 140. The control panel 140 orchestrates all function attributed with brushes and rollers.

The control panel 140 enables a user to input size and shape parameters pertaining to the hull 301 of the boat 300 to be washed via the invention 100. Upon input of said size and shape parameters, the control panel 140 manipulates applicable cylinders to adjust the left angle 129 of the plurality of left brushes 122, the right angle 139 of the plurality of right brushes 132, the roller elevation 113 of the plurality of rollers 109, the bottom brush elevation 121 of the plurality of bottom brushes 116. The control panel 140 is also responsible for controlling the applicable rotational speed output of the left brush motor 125 of all of the plurality of left brushes 122, the right brush motor 135 of all of the plurality of right brushes 132, the roller motor 111 of all of the plurality of rollers 109, and the brush motor 119 of all of the plurality of bottom brushes 116.

Referring to FIG. 2, the control panel 140 is wired to the various components. More specifically, a first wire 141, a second wire 142, and a third wire 143 (see FIG. 2) extend from the control panel 140 to one of the roller elevation cylinder 112, one of the brush elevation cylinder 120, and one of the right brush motor 135, respectively. It shall be noted that there is more wiring included for all of the componentry of the invention 100. The first wire 141, the second wire 142, and the third wire 143 are illustrative of a portion of the total wiring needs of the invention 100. It shall be noted that the different cylinders and motors mentioned above may be pneumatic, hydraulic, or electrical.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A water vessel washing system comprising:

a plurality of mounting posts that affix to a left side frame and a right side frame;

wherein the left side frame and the right side frame are configured to be partially submerged into a body of water;

wherein a plurality of rollers as well as a plurality of brushes rotate in order to be configured to propel a boat into and through the left side frame and the right side frame in order to be further configured to scrub clean a hull of said boat such that said boat is able to remain in said body of water;

wherein the plurality of mounting posts is further defined as a first mounting post, a second mounting post, a third mounting post, and a fourth mounting post;

wherein the first mounting post, the second mounting post, the third mounting post, and the fourth mounting post collectively interface with either a ground surface or a supporting structure in order to support the left side frame and the right side frame;

wherein the first mounting post and the second mounting post are affixed to a left side frame;

wherein the third mounting post and the fourth mounting post are affixed to a right side frame;

wherein the first mounting post is linearly aligned with the second mounting post;

wherein the third mounting post is linearly aligned with the fourth mounting post;

wherein the left side frame is parallel with the right side frame;

wherein the left side frame is separated from the right side frame via a width;

wherein the width shall be configured to accommodate a variety of differently-sized boats and their respective widths;

wherein the first mounting post, and the second mounting post support the left side frame at an elevation;

wherein the third mounting post, and the fourth mounting post support the right side frame at said elevation;

wherein the elevation is configured for use with a water level depth of said body of water;

wherein the left side frame and the right side frame are responsible for supporting the components attributed with washing the hull of the boat;

wherein the plurality of rollers extend between the left side frame and the right side frame;

wherein the plurality of rollers are generally parallel with one another;

wherein the plurality of rollers are perpendicular with respect to the left side frame and the right side frame;

wherein each of the plurality of rollers is mounted on a roller axle;

wherein the roller axle connects to a roller motor;

wherein the roller motor is attached to a roller elevation cylinder;

wherein the roller elevation cylinder is able to raise and lower the roller axle in order to adjust a roller elevation;

wherein the roller elevation is defined as a span from the ground to the one of the plurality of rollers.

2. The water vessel washing system according to claim 1 wherein each of the plurality of rollers is a concavely-shaped object that rotates with the roller axle; wherein the plurality of rollers is configured to propel the boat from a front entrance to a rear exit; wherein the front entrance is distal of the rear exit.

3. The water vessel washing system according to claim 2 wherein the plurality of brushes is further defined to include a plurality of bottom brushes; wherein the plurality of bottom brushes extend in between the left side frame and the right side frame; wherein the plurality of bottom brushes are positioned along a length; wherein the length the span from the front entrance to the rear exit.

4. The water vessel washing system according to claim 3 wherein the plurality of bottom brushes is parallel with the plurality of rollers; wherein the plurality of bottom brushes and the plurality of rollers are arranged sequentially such that one of the plurality of bottom brushes is adjacent to at least one of the plurality of rollers.

5. The water vessel washing system according to claim 4 wherein the plurality of bottom brushes is each affixed to a brush axle; wherein each brush axle is affixed to a brush motor; wherein the brush motor is attached to a brush elevation cylinder; wherein the brush elevation cylinder is able to raise and lower the brush axle in order to adjust a bottom brush elevation; wherein the bottom brush elevation is defined as a span from the ground to the one of the plurality of bottom brushes.

6. The water vessel washing system according to claim 5 wherein the plurality of brushes is further defined with a plurality of left side brushes; wherein the plurality of left side brushes are affixed to and pivot with respect to the left side frame; wherein each of the plurality of left side brushes is provided along a left inner surface of the left side frame; wherein each of the plurality of left side brushes is affixed to a left brush axle; wherein the left brush axle is attached to and rotates via a left brush motor; wherein the left brush motor is affixed to a left brush pivot arm; wherein the left brush pivot arm is pivotably attached to the left side frame via a left pivot pin.

7. The water vessel washing system according to claim 6 wherein each of the left side brushes includes a left pivoting cylinder; wherein the left pivoting cylinder attaches between the left brush pivot arm and the inner left surface of the left side frame; wherein the left pivoting cylinder is able to pivot a respective one of the plurality of left side brushes with respect to the hull of the boat; wherein a left angle forms relative the left inner surface of the left side frame and the respective one of the left side brushes; wherein the left angle is adjustable in order for increased effectiveness when the plurality of left brushes rotate in order to clean the hull of the boat.

8. The water vessel washing system according to claim 7 wherein the plurality of brushes is further defined with a plurality of right side brushes; wherein the plurality of right side brushes are affixed to and pivot with respect to the right side frame; wherein each of the plurality of right side brushes is provided along a right inner surface of the right side frame; wherein each of the plurality of right side brushes is affixed to a right brush axle; wherein the right brush axle is attached to and rotates via a right brush motor; wherein the right brush motor is affixed to a right brush pivot arm; wherein the right brush pivot arm is pivotably attached to the right side frame via a right pivot pin.

9. The water vessel washing system according to claim 8 wherein each of the plurality of right side brushes includes a right pivoting cylinder; wherein the right pivoting cylinder attaches between the right brush pivot arm and the inner right surface of the right side frame; wherein the right pivoting cylinder is able to pivot a respective one of the plurality of right side brushes with respect to the hull of the boat; wherein a right angle forms relative the right inner surface of the right side frame and the respective one of the right side brushes; wherein the right angle is adjustable in order for increased effectiveness when the plurality of right brushes rotate in order to clean the hull of the boat.

10. The water vessel washing system according to claim 9 wherein the right brush motor of all of the plurality of right brushes, the left brush motor of all of the plurality of left brushes, the roller motor of all of the plurality of rollers, and the brush motor of all of the plurality of bottom brushes are in communication with a control panel.

11. The water vessel washing system according to claim 10 wherein the brush elevation cylinder of the plurality of bottom brushes, the roller elevation cylinder of the plurality of rollers, the left pivoting cylinder of the plurality of left brushes, and the right pivoting cylinder of the plurality of right brushes are in communication with the control panel.

12. The water vessel washing system according to claim 11 wherein the control panel orchestrates all function attributed with the plurality of brushes and the plurality of rollers; wherein the control panel is configured to receive input as to a size and shape of the hull of the boat to be washed.

* * * * *